US010205226B2

(12) United States Patent
Li

(10) Patent No.: US 10,205,226 B2
(45) Date of Patent: Feb. 12, 2019

(54) MINIATURIZED DUAL-POLARIZED BASE STATION ANTENNA

(71) Applicant: Zimeng Li, Guangdong (CN)

(72) Inventor: Zimeng Li, Guangdong (CN)

( * ) Notice: Subject to any disclaimer, the term of this patent is extended or adjusted under 35 U.S.C. 154(b) by 79 days.

(21) Appl. No.: 15/023,557

(22) PCT Filed: Sep. 25, 2015

(86) PCT No.: PCT/CN2015/090647
§ 371 (c)(1),
(2) Date: Mar. 21, 2016

(87) PCT Pub. No.: WO2016/078475
PCT Pub. Date: May 26, 2016

(65) Prior Publication Data

US 2017/0250462 A1 Aug. 31, 2017

(30) Foreign Application Priority Data

Nov. 18, 2014 (CN) ..... 2014 1 0657578

(51) Int. Cl.
*H01Q 21/26* (2006.01)
*H01Q 1/24* (2006.01)
*H01Q 19/10* (2006.01)
*H01Q 25/00* (2006.01)

(52) U.S. Cl.
CPC ..... *H01Q 1/246* (2013.01); *H01Q 19/10* (2013.01); *H01Q 21/26* (2013.01); *H01Q 25/00* (2013.01); *H01Q 25/001* (2013.01)

(58) Field of Classification Search
CPC ..... H01Q 1/246; H01Q 19/10; H01Q 21/26; H01Q 25/00
See application file for complete search history.

(56) References Cited

U.S. PATENT DOCUMENTS

2007/0241983 A1* 10/2007 Cao ..... H01Q 9/28 343/797
2008/0169992 A1* 7/2008 Ortiz ..... H01Q 9/0428 343/767
2010/0007572 A1* 1/2010 Jones ..... H01Q 9/28 343/798
2011/0001682 A1* 1/2011 Rao ..... H01Q 9/0414 343/893
2011/0175782 A1* 7/2011 Choi ..... H01Q 1/246 343/798

* cited by examiner

*Primary Examiner* — Jessica Han
*Assistant Examiner* — Noel Maldonado
(74) *Attorney, Agent, or Firm* — Karthik Murthy; Murthy Patent Law PLLC

(57) ABSTRACT

The present invention discloses a miniaturized dual-polarized base station antenna, comprising a radiation device and a feeding unit. The feeding unit comprises two coaxial cables and two vertical baluns consisting of two conductors, and the radiation device is supported on a reflecting plate. The radiation device consists of four crossed oscillators and four groups of symmetric striplines, and the four groups of symmetric striplines are in the center of the radiation device and connected to the crossed oscillators and feed the four crossed oscillators in a matched manner. In the center of the radiation device, the adjacent conductors of the four groups of symmetric striplines are connected to each other to form an end-to-end connected closed conductor ring, and a top conductor sheet on the center of the radiation device is a square or circular metal member.

9 Claims, 3 Drawing Sheets

MINIATURIZED DUAL-POLARIZED BASE STATION ANTENNA

FIELD OF THE INVENTION

The present invention relates to a dual-polarized directional transceiver antenna having a horizontal lobe width of 55° to 75°, the two polarizations of which are orthogonal, for example, orthogonal horizontal and vertical polarizations or ±45° inclined polarizations.

BACKGROUND OF THE INVENTION

U.S. Pat. No. 3,740,754 is one of the earliest patents in which a dual-polarized antenna is described. This patent describes an oscillator consisting of two metal tubes which are connected to each other along a proper folding line and placed on a one reflecting cup, and the two groups of oscillators are respectively fed by two groups of coaxial cables. Subsequently, in order to extend the working band thereof, hundreds of different dual-polarized antennas have been developed.

U.S. Pat. No. 4,184,163 describes a broadband dual-polarized antenna. In this patent, the oscillator arm of the antenna consists of a metal ring which is in a finger ring shape or a square block shape. U.S. Pat. Nos. 5,481,272, 5,952,983, 6,028,563 and 60,724,39 describe several types of oscillators, including folded grid oscillators, tie oscillators and oscillators having additional PCB baluns.

In U.S. Pat. No. 6,747,606B2, US2005/0253769A1, US2013/0106668A1 and Chinese Patents CN201435451Y, CN102025023A, CN201845867U and CN102074781A, several types of crossed oscillators are described, and those oscillators include a radiation oscillator arm consisting of two branches to improve the lobe width.

Since crossed dipoles generate a wide lobe in the horizontal plane, in order to reduce the lobe width thereof, many more complex radiators have been invented. U.S. Pat. No. 5,940,044 describes an inclined dual-polarized antenna. Such an antenna has a horizontal half-power beam width of about 65°. This antenna includes several dipole sub-arrays, and each dipole is formed by arranging four single-dipoles in a rhombic shape, a diamond shape or regular cube shape. In this way, dipole sub-arrays are formed. Two single-dipoles in each dipole sub-array and the long sides of the reflecting plate are designed to be inclined at an angle of +45°. In this way, a +45° polarized radiation unit array is formed. The other two single-dipoles and the long sides of the reflecting plate are designed to be inclined at an angle of −45°. In this way, a −45° polarized radiation unit array is formed. In this patent, those dipoles are arranged in such a way that the phase centers of one +45° single-dipole and one −45° single-dipole, on a same side, are arranged along a first vertical line parallel to the long sides of the reflecting plate. Similarly, the phase centers of the other +45° single-dipole and one −45° single-dipole are arranged along a second vertical line. Such square dipoles have a major defect that one complex feeding network is required, for example, the four single-dipoles must be respectively fed by four coaxial cables.

EP0973231A2, U.S. Pat. No. 5,633,372B1, U.S. Pat. No. 6,529,172B2 and US2010/0309084A1 describe several radiators having a square pattern. For ease of manufacturing, the baluns of those dipoles are inclined with respective to the center line of the pattern of the square oscillator. Although it is a novel graphic structure, it is still very complex to manufacture such antennas.

U.S. Pat. No. 6,313,809B1 describes a dual-polarized radiator consisting of four single-dipoles. This radiator is appropriately placed on a reflector. When viewed from the top, the overall structure thereof is square. Each of the dipoles is fed by symmetric lines and has the following feature: the dual-polarized dipole radiator, in the electric aspect, radiates by using a polarization forming an angle of +45° or −45° with a structurally specified dipole. In this way, the ends of the symmetric lines of ½ dipoles are crisscross connected, that is, the respective ½ lines of the adjacent and vertical ½ dipoles are always electrically connected; and for the first polarization and the second polarization orthogonal to the first polarization, decoupling is realized, and it is able to electrically feed the opposite ½ dipoles, respectively.

Some other modifications of such square dipoles have been described in U.S. Patents and Chinese Patents U.S. Pat. No. 6,940,465B2, U.S. Pat. No. 7,688,271B2, CN202423543U, CN202268481U, CN101916910A, CN102097677A, CN102694237A, CN102544711A, CN201199545Y, CN102117967A and CN102013560A.

Patent WO2007/114620A1 describes a dual-polarized radiator consisting of four folded oscillators. This radiator employs a same arrangement as U.S. Pat. No. 6,313,809B1, and is properly placed on a reflecting plate. Some other medications of such folded oscillators have been described in Chinese Patents CN101707292A, CN201430215Y, CN202178382U and CN202004160U. In addition, Chinese Patents CN102377007A, CN201117803Y, CN201117803Y and CN101505007A describe formation of one square dipole pattern by capacitive coupling of several folded oscillators and one single-dipole.

When the bandwidth reaches 30%, forming one square dipole by those known radiators including four common or folded oscillators can provide a good directional diagram. However, those dipoles need a wide reflecting plate to generate a good front-to-back ratio. When a radiation deployment device thereof is placed on one reflecting plate, the height of the oscillators is approximately ¼ wavelengths of the center working frequency. Hence, the known radiators have a large size.

In order to overcome those defects, many other dual-polarized radiators having a small size have been invented. U.S. Pat. Nos. 6,933,906B2, U.S. Pat. No. 7,132,995B2 and US2012/0235873A1 and Chinese Patents CN102074779A, CN102157783A, CN101707291A, CN101572346A, CN201741796U, CN101546863A, CN101673881A, CN202150554U, CN102246352A, CN102484321A, CN202423541U, CN102544764A and CN101707287A describe many crossed dipoles having different oscillator arms. In the horizontal plane, since the lobe width of crossed dipoles is too large, it is necessary to reduce the lobe width by a large side. In this way, the size of the antenna may still be very large, for example, as described in U.S. Pat. No. 7,679,576.

Patent WO 2007/114620A1 describes a square dipole formed of a folded oscillator consisting of one connection portion and a connected oscillator arm. U.S. Patent US2009/0179814 A1 describes a dual-polarized broadband antenna, the radiation device of which includes folded oscillators, as the prior art, and FIG. 1 shows a radiator thereof.

SUMMARY OF THE INVENTION

In order to solve the above problem, an objective of the present application is to provide a high-quality miniaturized dual-polarized base station antenna. Such a miniaturized dual-polarized base station antenna must be capable of providing a high-quality directional diagram. For example, this miniaturized dual-polarized base station antenna must have a large cross polarization ratio, front-to-back ratio or the like. Whereas, the exiting known dual-polarized antennas all include a wide-size reflector by which a large front-to-back ratio is generated. Hence, those antennas all have a large appearance size. On this basis, the first purpose of the present application is to reduce the physical size of a dual-polarized antenna as much as possible, that is, to obtain a miniaturized antenna. The second purpose of the present invention is to enable the miniaturized dual-polarized antenna to still have the same indexes, for example, front-to-back ratio, cross polarization ratio or the like, as the traditional large-size dual-polarized antennas. The third purpose of the present invention is to invent an excellent broadband matched feeding network for such a miniaturized antenna radiation device.

To achieve the above purposes, a miniaturized dual-polarized antenna base station of the present application includes a radiation device and a support conductor unit. The support conductor unit supports and secures the radiation device on the reflecting plate, wherein two support conductors form two vertical baluns, and the radiation device is activated by two coaxial cables in the center of the radiation device so that it generates two vertical linear electromagnetic fields. Those linear electromagnetic fields have an E-vector parallel to the geometric diagonal of the radiation device.

Secondly, the radiation device of the present application includes four folded oscillators and feeds them by four groups of symmetric striplines in a matched manner. Among the four groups of symmetric striplines, conductors of each two groups of adjacent striplines are connected together in the middle of the radiation device and form a flat and mutually-connected self-supported structure.

In addition, the reflecting plate of the antenna of the present application is much smaller than the reflecting plate of the existing known antennas. The radiation device is placed on this small-size reflecting plate. The radiation device includes an additional conductor element which is located between ends of the adjacent folded oscillators, and another conductor element is located on the geometric center of the radiation conductor. Those additional conductors improve the front-to-back ratio and the cross polarization ratio on one hand, and on the other hand, when the radiation device is placed on one small-size reflecting plate, those additional elements are matched with the coaxial feeding network.

BRIEF DESCRIPTION OF THE DRAWINGS

The accompanying drawings are incorporated to constitute part of the description, and to elaborate the specific embodiments of the present application and explain the principle of the present application together with the following detailed description of the present application.

DETAILED DESCRIPTION OF THE PREFERRED EMBODIMENTS

Figure 1:
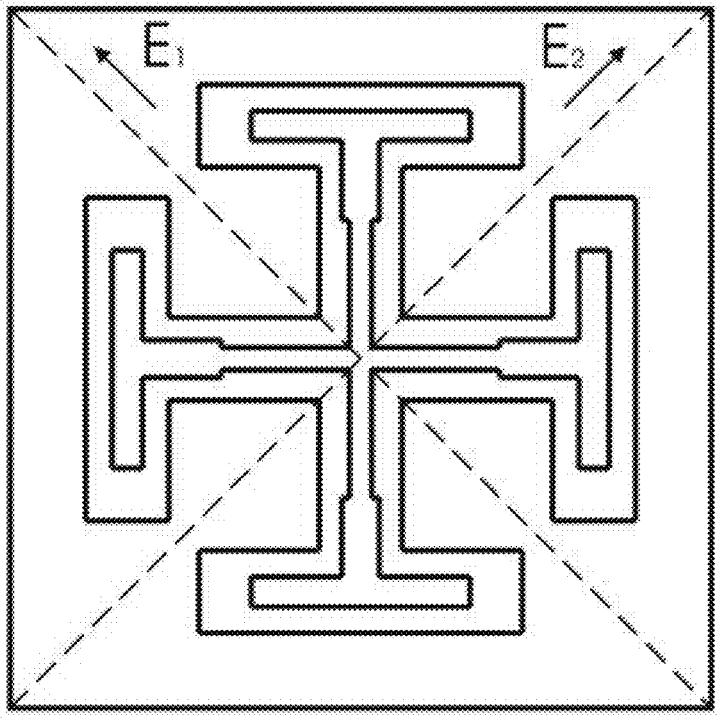
FIG. 1 is a dual-polarized broadband antenna which is derived from the prior art (U.S. Patent US2009/0179814 A1), showing a radiation device including four folded oscillators which are fed by four groups of symmetric feeding lines and connected together in the center of the radiation device.

FIG. 1 is a dual-polarized broadband antenna which is derived from the prior art (U.S. Patent US2009/0179814 A1), showing a radiation device including four folded oscillators which are fed by four groups of symmetric feeding lines and the adjacent conductors of each two groups of symmetric feeding lines are connected together in the center of the radiation device. The radiation device is activated by two coaxial cables placed in the center of the radiation device so that it generates two vertical linear electromagnetic fields. Those linear electromagnetic fields have an E-vector parallel to the geometric diagonal of the radiation device.

Figure 2:
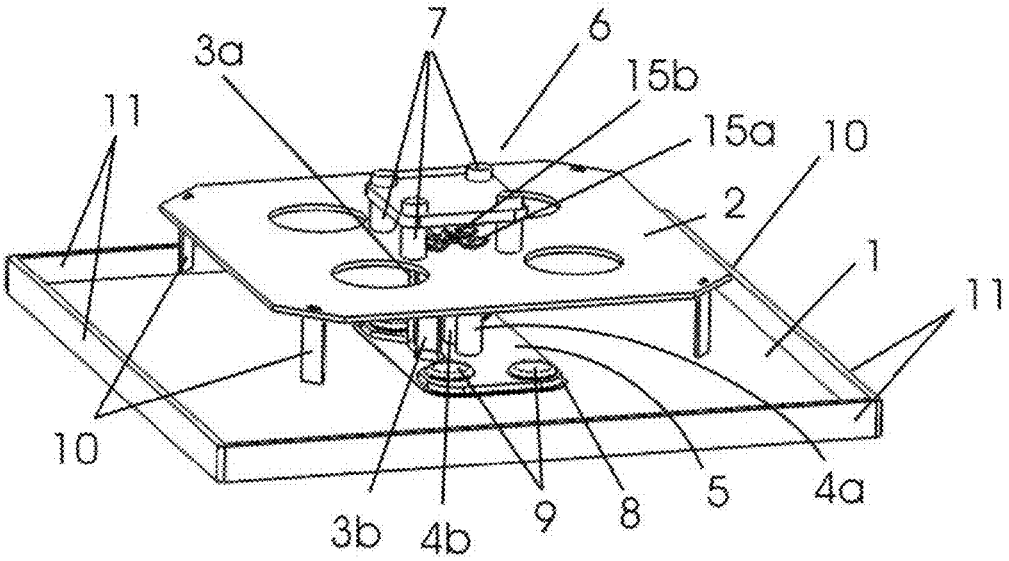
FIG. 2 is a stereoscopic structure diagram of one embodiment of a radiation unit of a miniaturized dual-polarized base station antenna of the present application, including a radiation device and an additional conductor element both placed on a reflecting plate.
Figure 3:
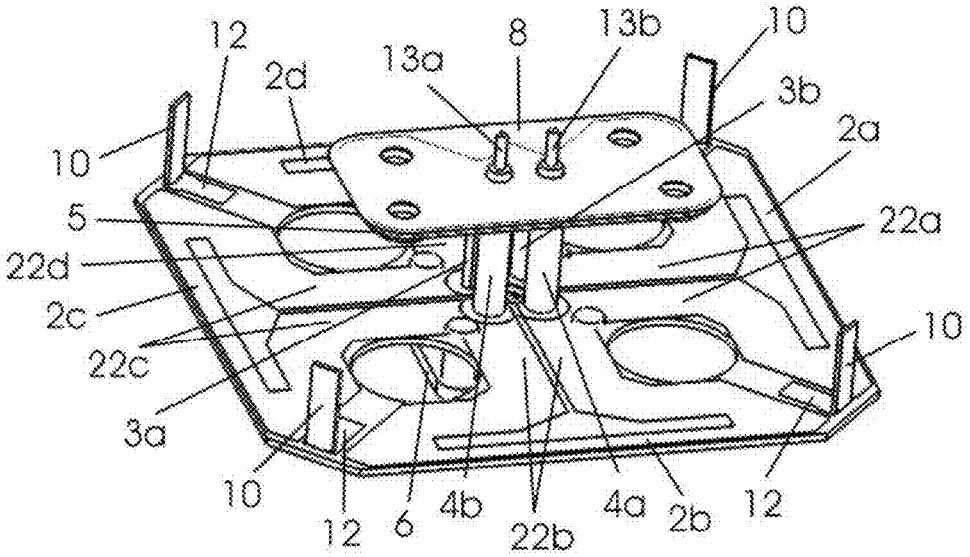
FIG. 3 is a stereoscopic bottom structure diagram of the radiation unit of the miniaturized dual-polarized base station antenna of FIG. 2, the radiation unit having two support conductors and two coaxial cables for feeding which are connected together by a metal base plate.

FIG. 2 shows a first embodiment of the present application. A radiation device manufactured from a printed circuit board, and two vertical baluns supported on the reflecting plate 1 are included. The reflecting plate 1 is much smaller than the reflecting plate of the existing known antennas. Four folded oscillators 2*a*, 2*b*, 2*c* and 2*d* are fed by four groups of symmetric striplines 22*a*, 22*b*, 22*c* and 22*d* which are placed on a bottom surface of a medium substrate 2, as shown in FIG. 3. A support conductor 3*a* and an outer conductor 4*a* of the coaxial cable are connected to a metal base plate 5 to form a first balun. Similarly, the second balun is formed by connecting a support conductor 3*b* and an outer conductor 4*b* of the coaxial cable to the metal base plate 5, and the support conductors 3*a* and 3*b* are less than 0.15 wavelengths of the center working frequency thereof. Bottom ends of the support conductors 3*a* and 3*b* are connected to the outer conductors 4*a* and 4*b* by a conductor base plate 5, a top conductor plate 6 is supported on the medium substrate 2 by an insulating support column 7, the conductor base 5 is isolated from the reflecting plate by an insulating medium film 8, and the conductor base plate 5 is secured onto the reflecting plate 1 by a plastic rivet 9. Hence, in the embodiment, no passive inter-modulation will be caused by the connection problem between metal members. A conductor 10 is welded and located at the corner of the medium substrate 2, and is directed to the reflecting plate 1. A side plate 11 is located at an edge of the medium substrate 2.

FIG. 3 shows a lower surface of the medium substrate 2. Four folded oscillators 2*a*, 2*b*, 2*c* and 2*d* are included. The four folded oscillators are respectively fed by four groups of symmetric striplines 22*a*, 22*b*, 22*c* and 22*d*, and four identical conductors 12 are located between ends of the folded oscillators on the lower surface of the medium substrate 2. Four identical conductors 10 are respectively connected to the four conductors 12.

The top end of the support conductor 3*a* is connected to a position where two adjacent groups of symmetric striplines 22*c* and 22*d* are connected; and similarly, the top end of the support conductor 3*b* is connected to a position where two adjacent groups of symmetric striplines 22*a* and 22*d* are connected. The top end of the outer conductor 4*a* of the coaxial cable is connected to a position where two adjacent groups of symmetric striplines 22*a* and 22*b* are connected; and similarly, the top end of the outer conductor 4*b* of the coaxial cable is connected to a position where two adjacent groups of symmetric striplines 22*b* and 22*d* are connected.

Figure 4:
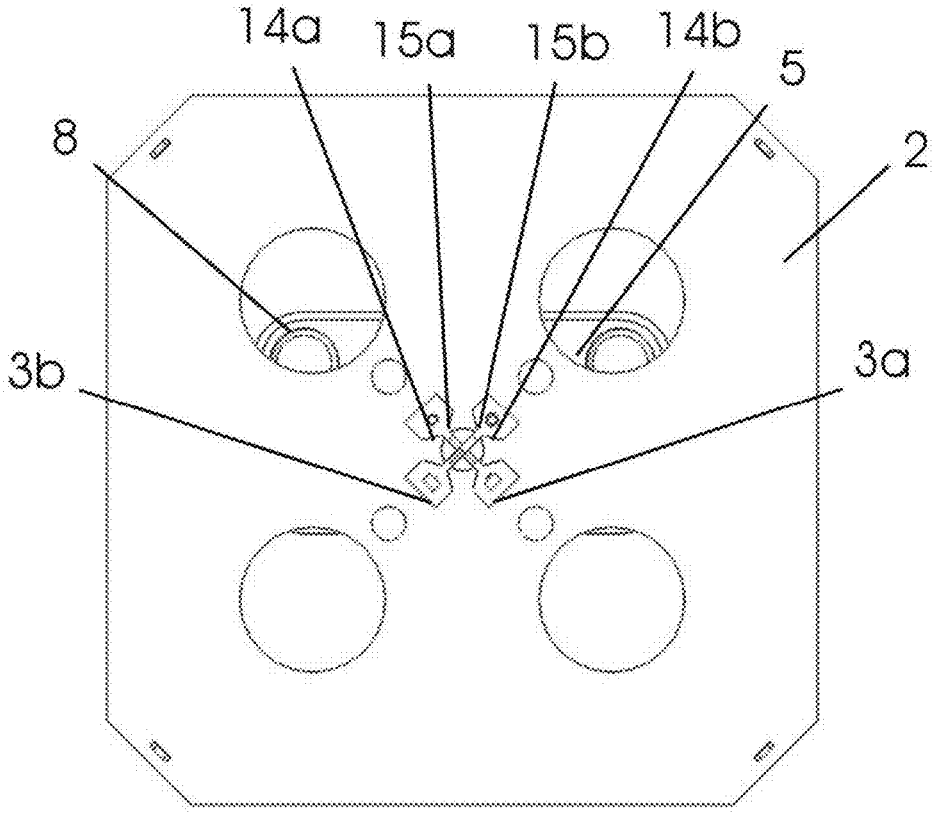
FIG. 4 is a top view of a radiation device, without a top metal plate, in the radiation unit of the miniaturized dual-polarized base station antenna of FIG. 2.

FIG. 4 is a top view of a medium substrate 2 without a top conductor plate 6. Inner conductors 14*a* and 14*b* of the coaxial cables 4*a* and 4*b* are respectively connected to the top ends of the support conductors 3*a* and 3*b* by conductor bridges 15*a* and 15*b*.

The conductor 10 is capacitive coupled to the ends of the folded oscillators and the reflecting plate 1. Hence, RF current flows along the conductor 10 and generates a directional radiation along the reflecting plate. The E-vector of the radiated electric field is directionally vertical to the reflecting plate. This radiation improves the beam width in the E-plane and inhibits the radiation of the folded oscillators in the rear direction to some extent. Conductors 12 are connected to the conductor 10, thereby improving the capacitive coupling between the conductor 10 and the ends of the folded oscillators. Hence, the conductor 10 and the conductors 12 increase the front-to-back ratio of the antenna, and generate a radiation having an E-vector directionally vertical to the reflecting plate. This radiation increases the cross polarization ratio of the antenna at the edge of a region of ±60°. As a result, when the antenna has a small reflector, this miniaturized antenna has a same front-to-back ratio and a same cross polarization ratio at the edge of a region of ±60° as the traditionally known antennas having a large reflecting plate.

The upper conductor plate 6 is activated by the conductor bridges 15*a* and 15*b*. The appearance size of the upper conductor plate 6 is smaller than that of the folded oscillators. Hence, the upper conductor plate 6 radiates the high band in the working band. The radiation of the upper conductor plate 6 is different from the radiation of the folded oscillators because the radiation of the folded oscillators is activated by ends of four groups of symmetric striplines, and the radiations of the two in the high band of the working band are different. This inhibits the radiation from the folded oscillators to some extents. Hence, the radiation of the upper conductor plate 6 improves the beam width of the antenna in high band of the working band. As a result, when the distance between the oscillators of the antenna and the reflecting plate is less than 0.15 wavelengths of the center working band, the antenna has same indexes as the traditional antennas. The distance between the oscillators of the traditional antennas and the reflecting plate is about 0.25 wavelengths.

The radiation of the upper conductor plate 6 and the conductors 10 and 12 inhibit the radiation of the folded oscillators to some extent. As a result, when the distance between the oscillators of the antenna and the reflecting plate is less than 0.15 wavelengths of the center working band, the antenna will generate the same matched bandwidth as the traditional antennas by the feeding cables. The distance between the oscillators of the traditional antennas and the reflecting plate is about 0.25 wavelengths.

Figure 5:
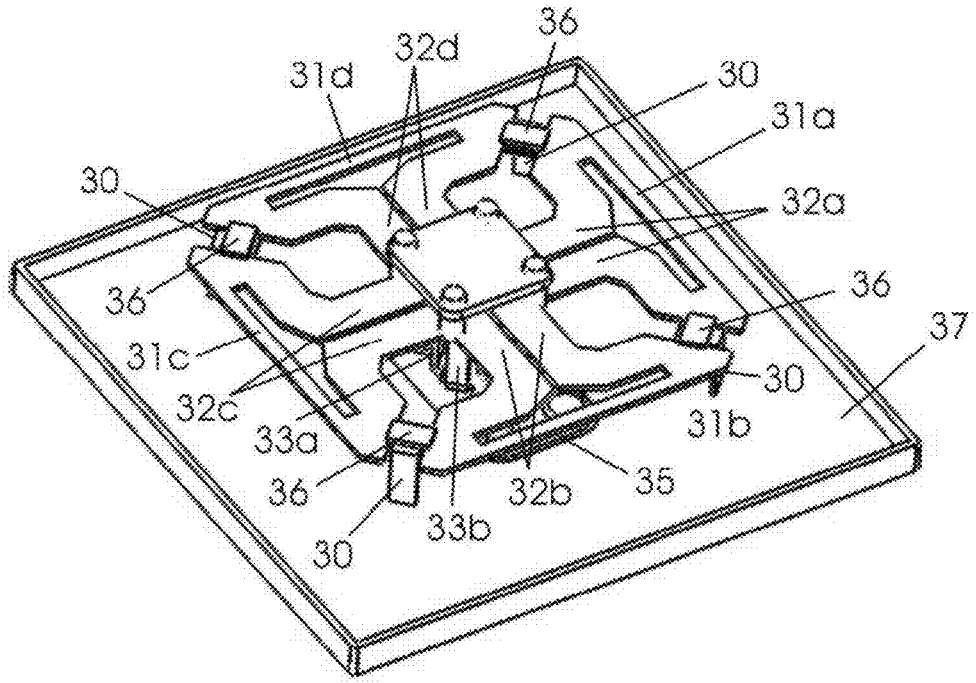
FIG. 5 is a stereoscopic structure diagram of a second embodiment of a radiation unit of a miniaturized dual-polarized base station antenna of the present application, the radiation device and two vertical baluns being integrally cast or die-cast into a metal die to form an integrated metal oscillator.

FIG. 5 shows a second embodiment of the present application. The radiation device includes four folded oscillators 31*a*, 31*b*, 31*c* and 31*d* which are connected to the symmetric striplines 32*a*, 32*b*, 32*c* and 32*d* of the folded oscillators, and two vertical baluns which are cast into a body by die-casting. The first balun consists of a support conductor 33*a*, outer conductors of coaxial cables, and a base plate 35 connecting them together.

Conductors 30 are supported between ends of the adjacent folded oscillators by an insulating medium gasket 36, and each conductor 30 is bent to a right angle. A part of each of the conductors 30 is secured in the insulating medium gasket 36, while the other part thereof is directed to the reflecting plate 37. Hence, the conductors 30 function as the conductors 10 and 12 in FIG. 4. The second embodiment of the present application as shown in FIG. 5 has the same advantages as the first embodiment. However, this embodiment is applicable to massive production, with lower production cost and higher power resistant ability.

Figure 6:
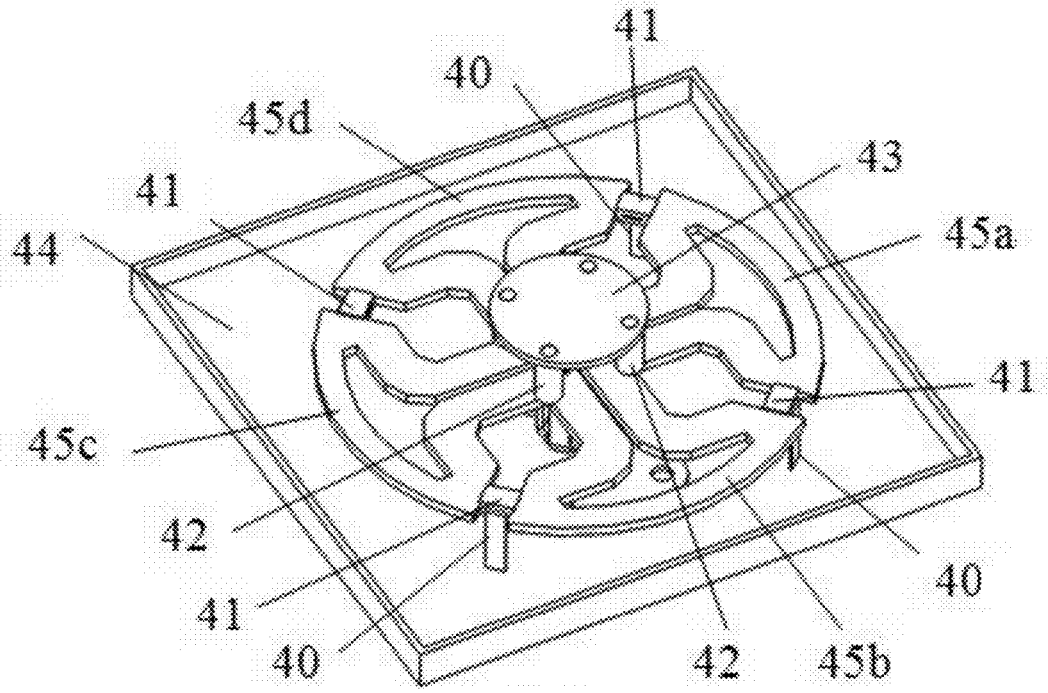
FIG. 6 is a stereoscopic structure diagram of a variation of the embodiment of FIG. 5, where a circular integrated metal oscillator is formed.

FIG. 6 shows another metal embodiment of the present application. The radiation device includes folded oscillators 45*a*, 45*b*, 45*c* and 45*d* which are of a circular structure and cast to form a circular metal body by die-casting. An insulating support column 42 supports a top conductor 43 above the radiation device, conductors 40 are supported between ends of the adjacent folded oscillators by an insulating medium gasket 41, and each conductor 40 is bent to a right angle. A part of each of the conductors 40 is secured in the insulating medium gasket 41, while the other part thereof is directed to the reflecting plate 44. Hence, the conductors 40 function as the conductors 10 and 12 in FIG. 4. The embodiment of the present application as shown in FIG. 6 has the same advantages as the embodiment as shown in FIG. 5.

According to the design concept of the present application, a 1710-2200 MHz ±45° dual-polarized antenna sample is designed, where the distance between the oscillators and the reflecting plate is about 20 mm, and the size of the reflecting plate is 120*120 mm. By matched tests, the horizontal half-power beam width of the antenna is 60° to 68°, and the VSWR is 1.20. Further, a ±45° polarized electrically-tunable array antenna including five such radiation units is designed, where, for this electrically-tunable array antenna, the cross-sectional size is only 120*45 mm, the front-to-back ratio within 1710-2200 MHz is superior to 28 dB, the cross polarization ratio is superior to 27 dB, the cross polarization ratio in the main direction is superior to 25 dB, and the cross polarization ratio at the edge of a region of ±60° is superior to 10 dB, and the VSWR is superior to 1.25.

In conclusion, the present application provides a design of a miniaturized base station antenna, which has the same technical indexes as the traditional large-size antennas. Furthermore, this technology may be applied to the development of antennas in any other bands to reduce the physical size of antennas, for example, may be applied to a 690-960 MHz or 1710-2710 MHz electrically-tunable array antennas to reduce the physical size thereof. Hence, the above description is just one of several preferred embodiments of the present application, and is not used for limiting the technical scope of the present application in any form. For those skilled in the art, some variations and modification may be made under the teaching of the present technical solution, and any modifications, equivalent changes and embellishments of the above embodiment made according to the technical essence of the present application shall be regarded as falling into the technical scope of the present application.

What is claimed is:

1. A miniaturized dual-polarized base station antenna, comprising a radiation device and a feeding unit; wherein the feeding unit comprises two coaxial cables and two vertical baluns consisting of two support conductors, and the radiation device is supported on a reflecting plate;

the radiation device consists of four folded oscillators and four groups of symmetric conductor striplines, and the four groups of symmetric conductor striplines are in the center of the radiation device and respectively connected to the four folded oscillators and feed the four folded oscillators in a matched manner;

the distance between the radiation device and the reflecting plate is less than 0.15 wavelengths of the center frequency in the working band of the radiation device;

the four groups of symmetric conductor striplines are end-to-end connected to each other in the center of the radiation device;

top ends of outer conductors of the coaxial cables and top ends of the support conductors are respectively connected to the four groups of symmetric conductor striplines in the center of the radiation device, and the connection positions are places where adjacent symmetric conductor striplines are connected, i.e., corners where symmetric conductor striplines are connected;

bottom ends of the outer conductors of the coaxial cables and bottom ends of the support conductors are connected to a metal base plate;

inner conductors of the coaxial cables are connected to the support conductors by a conductor bridge placed on the radiation device, and the conductor bridges connects the inner conductors of the coaxial cables and the support conductors along the diagonal direction of the radiation device;

rectangular conductors are provided between ends of the four adjacent folded oscillators, there are total four rectangular conductors each being independently connected with a conductor, and the independently-connected conductor is located between a radiator and the reflecting plate; and a top planar conductor is provided on the geometric center of the radiation device.

2. The miniaturized dual-polarized base station antenna according to claim 1, wherein the folded oscillators are printed circuit board members, and conductors are provided between ends of the adjacent folded oscillators.

3. The miniaturized dual-polarized base station antenna according to claim 1, wherein the radiation device and the two vertical baluns form an integrated metal oscillator having an overall square or circular appearance.

4. The miniaturized dual-polarized base station antenna according to claim 1, wherein the top planar conductor is supported on the geometric center of the radiation device by an insulating support column.

5. The miniaturized dual-polarized base station antenna according to claim 1, wherein the top planar conductor is a square or circular metal member.

6. The miniaturized dual-polarized base station antenna according to claim 1, wherein an insulating medium sheet is provided between the metal base plate and the reflecting plate.

7. The miniaturized dual-polarized base station antenna according to claim 1, wherein the reflecting plate has sides.

8. The miniaturized dual-polarized base station antenna according to claim 1, wherein conductor bars are secured between ends of the adjacent folded oscillators, and the conductor bars are bent and supported between the reflecting plate and the radiation device by a medium gasket.

9. The miniaturized dual-polarized base station antenna according to claim 2, wherein conductor bars are secured between ends of the adjacent folded oscillators, and the conductor bars are bent and supported between the reflecting plate and the radiation device by a medium gasket.

* * * * *